United States Patent [19]

Prew

[11] 4,447,011

[45] May 8, 1984

[54] PLATE ADJUSTMENT SYSTEM

[75] Inventor: Stanley Prew, Montoursville, Pa.

[73] Assignee: Koppers Company, Inc., Pittsburgh, Pa.

[21] Appl. No.: 331,068

[22] Filed: Dec. 16, 1981

Related U.S. Application Data

[63] Continuation of Ser. No. 91,083, Nov. 5, 1979, abandoned.

[51] Int. Cl.[3] ..... B02C 7/14

[52] U.S. Cl. ..... 241/37; 241/259.2

[58] Field of Search ..... 241/37, 259.2, 259.3, 241/247, 261.2, 261.3, 261, 259.1

[56] References Cited

U.S. PATENT DOCUMENTS

| | | | |
|---|---|---|---|
| 2,947,485 | 8/1960 | Woodruff et al. | 241/259.2 X |
| 3,323,731 | 6/1967 | Asplund et al. | 241/259.2 X |
| 4,073,442 | 2/1978 | Virving | 241/259.2 X |

*Primary Examiner*—Mark Rosenbaum

*Attorney, Agent, or Firm*—Thomas F. Shanahan; Daniel J. Long; Herbert J. Zeh, Jr.

[57] ABSTRACT

A disc type refiner, for paper pulp processing and the like, is provided with an automatic control mechanism to prevent contact-clashing of the refiner plates on short term losses of feed and to sense the long term losses of feed so as to open the refiner plates before contact-clashing occurs. The control mechanism includes a counter-force-producing means acting in opposition to the refining or attrition force-producing means such that, on either short or long term loss of feed, resistance to plate clashing is provided. Moreover, the counter-force-producing means is monitored and the monitor provides signals to actuate, in cooperation with other control devices, a desired sequence of operative steps to effectuate either the continuation or the discontinuation of the refining operation.

12 Claims, 4 Drawing Figures

PLATE ADJUSTMENT SYSTEM

This is a continuation of application Ser. No. 091,083, filed Nov. 5, 1979, now abandoned.

BACKGROUND OF THE INVENTION

1. Field of the Invention

This invention relates to disc type refiners or attrition mills and, more specifically, to a disc type refiner provided with a plate-clash protection system. In particular, the present invention relates to a disc type refiner having a plate clash protection system that permits the plate gap to vary in accordance with variations in the feed, as opposed to existing systems that attempt to maintain a constant refining gap or plate gap with variations in feed and, notwithstanding, a system that effectively prevents the occurrance of potentially destructive plate clashing.

2. Description of the Prior Art

Disc type refiners are well known, particularly in the paper-making field, and essentially comprise juxtaposed annular refining surfaces which are arranged for relative rotation so that material introduced at the inner edge of the surfaces is transported between the surfaces and peripherally discharged in a refined condition. Disc refiners commonly comprise either single pair of refining surfaces or, in the twin refiners, a double pair of refining surfaces. One type of single refiner is characterized by a rotationally and axially fixed refiner head which cooperates with an axially adjustable rotatable head. In another type of single refiner, the heads are counter-rotating with one being axially fixed and the other being axially adjustable. A further type is characterized by a rotating head which is axially fixed and a nonrotating head having means for axial ajustment to change the refining plate clearance or gap.

Twin refiners, on the other hand, typically include a central rotating head having attrition plates on both sides thereof cooperating with oppositely disposed, rotationally fixed plates. One or both of the heads supporting the fixed plates may be axially adjustable to vary the plate spacing, and the shaft carrying the rotating head may be either axially adjustable, fixed or freely floating. Alternatively, the twin refiner may have a pair of non-rotating, axially fixed heads and a pair of axially adjustable rotating heads disposed therebetween. The pair of rotating heads may be driven in rotation, for example, by a central driving disc, on the drive shaft, having lugs extending from each side thereof engaging similar lugs on the rotating heads. The present invention is adaptable to any of the aforementioned structures. However, a specific example of a twin refiner for which the present invention is particularly well suited is fully disclosed in U.S. Pat. No. 3,847,359, assigned to the assignee of the present invention and the disclosure of which is intended to be incorporated herein by reference.

As is disclosed in the aforementioned patent, a number of parameters are determinative of the refining effect produced by disc type refiners, including the spacing of the plates, the flow rate of stock between the plates, the speed of rotation of the disc, the refining plate pattern and the consistency of the stock. Of these parameters, perhaps the most difficult to control is the plate gap or the spacing of the plates. While some slight variation in plate gap is permissible in normal operation, it is never permissible or desirable to permit the plates to come together, i.e., clash. This is particularly true of a refiner of a size class that involves the use of motors operating in the range of 7,000–15,000 horsepower. As will be appreciated, with a normal refining plate spacing of 0.002 to 0.003 inch, while operating with a motor capable of producing upwards of 15,000 horsepower, the occurrence of a plate clash would potentially be so destructive that a highly reliable plate protection system is an absolute necessity. However, prior to this invention no such system was available.

Generally, in known prior art refiner plate protection systems, other than as practiced by the assignee of the present invention, two principal approaches have been taken. One is to use a linear voltage differential transformer (LVDT) or the like to monitor machine stretch as a measure of the attrition force. The other is to use a hydraulic sensor system to monitor machine stretch as a measure of the attrition force. However, in both cases the systems are designed to achieve positive plate positioning, i.e., continuously compensating, by adjusting the attrition force, in an attempt to maintain a constant, predetermined plate gap. Notwithstanding, since neither systems can compensate for machine stretch totally, they do permit plate clashes to occur. In the above connection, reference is made to the plate protection systems disclosed in U.S. Pat. Nos. 3,799,456 to Jewell et al. and 3,212,721 to Asplund et al.

SUMMARY OF THE INVENTION

In accordance with the present invention, there is provided a disc type refiner having an automatic control mechanism to prevent contact-clashing of the refiner plates on short term losses of feed and to sense the long term losses of feed so as to open the refiner plates before contact-clashing occurs. The control mechanism includes a counter-force-producing means acting in opposition to the refining or attrition force-producing means such that, in either short or long term loss of feed, resistance to plate clashing is provided. Moreover, the counter-force-producing means is monitored and the monitor provides signals to actuate, in cooperation with other control devices, a desired sequence of operative steps to effectuate either the continuation or the discontinuation of the refining operation. Futhermore, the plate clash protection system of this invention is designed to permit the plate gap to vary in accordance with variations in the feed, as opposed to prior art systems that attempt to maintain a constant refining gap with variations in feed and, notwithstanding, provides a system that effectively prevents the occurrance of destructive plate clashing.

The foregoing and other objects, features and advantages of this invention will become more apparent when taken in conjunction with the following specifications, the accompanying drawings and the appended claims.

BRIEF DESCRIPTIONS OF THE DRAWINGS

DESCRIPTION OF PREFERED EMBODIMENTS

Figure 1:
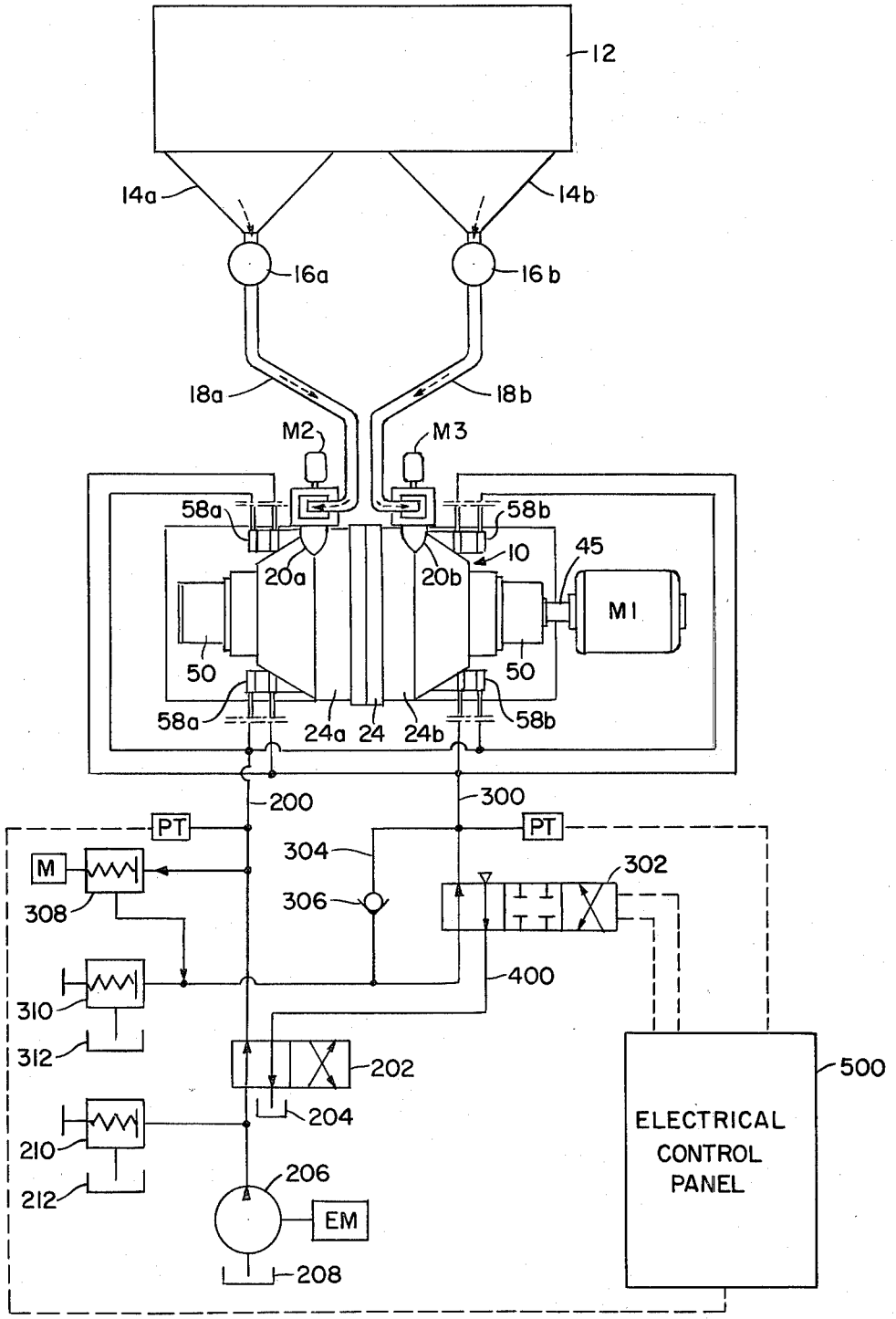
FIG. 1 is a schematic view illustrating a preferred embodiment of a disc type refiner having a plate clash protection system in accordance with the present invention.

Referring to the drawings and, in particular, to FIG. 1, there is shown schematically a preferred embodiment of the present invention including a disc type refiner, generally designated 10 and the hydraulic and electrical circuits pertaining to the plate clash protection system of the invention. The stock to be refined, which might typically comprise high consistency (low water content) woodchips, is stored in a bin 12 and drops from bin hoppers 14*a* and 14*b* to feeders 16*a* and 16*b* respectively. From the feeders, the stock passes through conduits 18*a* and 18*b* into infeed conveyors 20*a* and 20*b* respectively, of the refiner. For convenience in illustrating the refiner operation, the refiner is schematically shown in FIG. 1 in a top plan view, although the bins, feeders and conduits are shown in side elevation.

Figure 2:
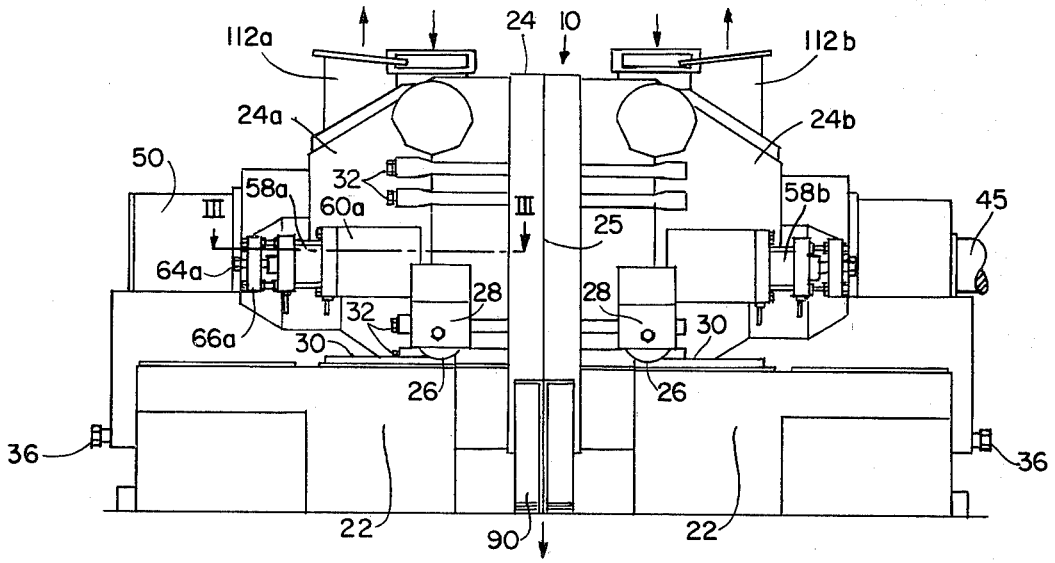
FIG. 2 is a side elevation of the disc type refiner shown schematically in FIG. 1.
Figure 3:
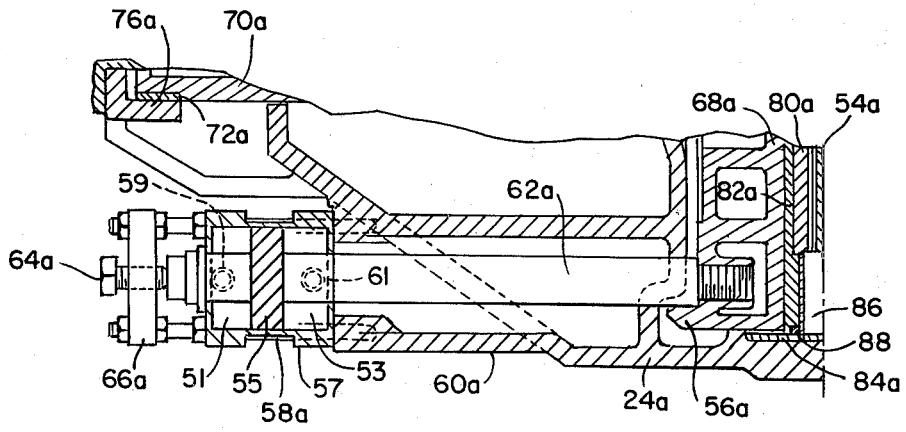
FIG. 3 is an enlarged partial section view, taken along the line III—III of FIG. 2, showing details of one of the attenuation force-producing and counter-force-producing hydraulic cylinders of the invention.
Figure 4:
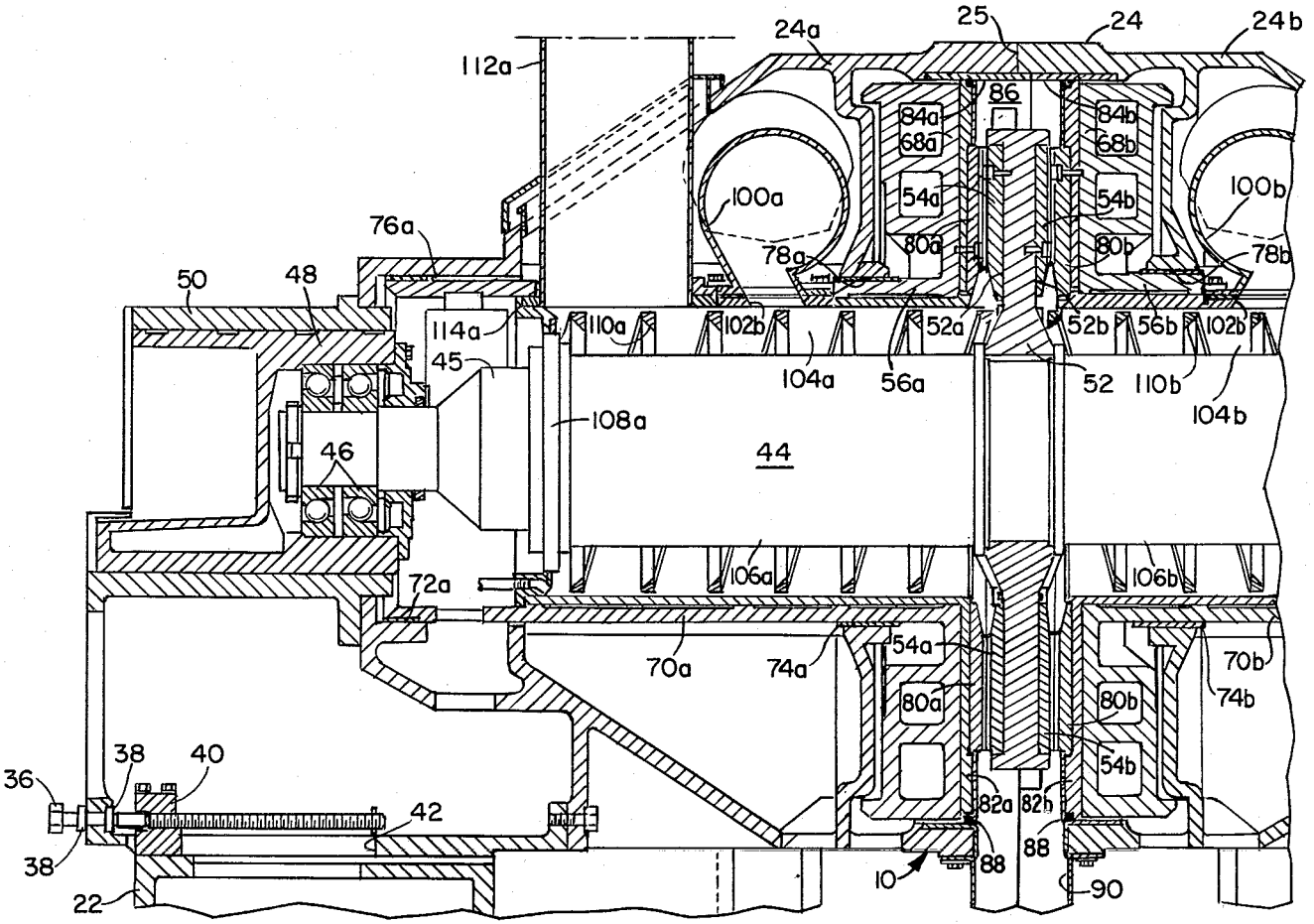
FIG. 4 is an enlarged partial section view of the refiner of FIGS. 1 and 2 showing interior refiner details.

The details of a preferred form of refiner for use in combination with the present plate clash protection system are shown in FIGS. 2–4. A refiner base 22 supports a casing 24 formed by casing sections 24*a* and 24*b* which are separable along vertical interface 25. Grooved wheels 26 journaled in members 28, extending from each side of the casing sections, movably support the sections on parallel rails 30 on the base 22. The casing sections are secured together during operation of the refiner by a plurality of bolts 32 spaced along the sides of the sections perpendicular to and spanning the interface 25 therebetween. The casing sections are readily separable to change the refiner plates or for other servicing of the unit by opening the bolts 32 and by rotation of a positioning screw 36 at the bottom of the outer end of each casing section. Each screw 36 is rotationally secured to its casing section by the collars 38 thereon and threadably engages a block 40 on the base 22 which extends upwardly through a slot 42 in the casing section. The rotation of each screw 36 will accordingly move its casing sections on the tracks 30 along the longitudinal axis of the refiner.

A rotor 44 passes centrally through the casing and includes a rotor shaft 45 which is supported at the outer end of each casing section. As shown in FIG. 4, one end of the rotor shaft is journaled in casing section 24*a* by bearings 46 which are mounted in a bearing support member 48 and secured therewithin by a clamping ring 50. Member 48 is slidably disposed within its casing section to permit axial displacement of the section without changing the position of the rotor with respect to the base. The rotor shaft extends through the casing section 24*b* as shown in FIGS. 1 and 2 and is journaled within this casing section in a manner similar to that shown in FIG. 4. Although bearings 46 are combined radial and thrust bearings, the bearing assembly in section 24*b* should include only radial bearings to allow for axial thermal expansion of the rotor. Refiner motor M1 as shown in FIG. 1, is connected to the extending rotor shaft, and for large size refiners, may be as large as upwards of 15,000 horsepower.

A radially extending rotor disc 52 is centrally mounted on the rotor shaft within the casing and is keyed to the shaft for rotation therewith. Sets of refining plates 54*a* and 54*b* of conventional construction are bolted to the opposite faces 52*a* and 52*b* of the disc 52. Disposed within the respective casing sections 24*a* and 24*b* and axially juxtaposed the faces 52*a* and 52*b* of the rotor disc are the non-rotating heads 56*a* and 56*b* which are axially slidable within the casing sections. As shown in FIGS. 1, 2 and 3, the non-rotating heads are each respectively connected to a pair of diametrically opposed hydraulic piston-cylinder assemblies 58*a* and 58*b* which, among other things, control the axial position of the heads, are utilized in the plate clash protection system of this invention and provide the attrition force during refining.

The details of one of the hydraulic piston-cylinders 58*a* are shown in FIG. 3. The piston-cylinder 58*a* is bolted to a projecting portion 60*a* of the casing section and the cylinder piston rod 62*a* extends through the casing section into threaded attachment to the axially movable head 56*a*. Piston 55 is slidably received within cylinder 57 and, additionally, there are provided threaded bores or ports 59 and 61 communicating, respectively, with the cylinder portions on either side of the piston 55. The outward travel of the piston rod is controlled by the stop bolt 64*a* supported coaxially outwardly of the piston-cylinder 58*a* by a supporting member 66*a* secured thereto. The range of allowable axial movement of the non-rotating head is small and, in practice, the head positioning or refining gap required during operation is only a few thousandths or a small fraction of an inch.

As shown in FIG. 4, the non-rotating heads 56*a* and 56*b*, respectively, include radially extending plate support portions 68*a* and 68*b* and cylindrical portions 70*a* and 70*b* coaxial with the longitudinal axis of the refiner. Cylindrical outer bearing elements, only one of which is shown at 72*a*, and similar inner bearing elements 74*a* and 74provided with seal rings (not shown) respectively support the movable heads in axially slidable sealed relation to the respective casing section surfaces at 76*a*, 78*a* and 78*b*. Refiner plates 80*a* and 80*b* are bolted to the radial faces of the non-rotating heads in respectively juxtaposed relation to the plates 54*a* and 54*b* of the rotor 52. Thus, two pairs of refiner plate assemblies arranged in tandem are provided. Ring shaped, radially disposed elements 82*a* and 82*b* extending from between the head portions 68 and the plates 80 seal the non-rotating heads against cylindrical elements 84*a* and 84*b* secured to the casing sections and form an annular chamber 86 between the non-rotating heads and circumferentially of the rotor, into which the refined products are discharged. Seal rings 88 between the members 82*a* and 82*b* and the plates 84 permit sliding movement of the heads with respect to the casing while maintaining the sealed condition of the annular chamber 86. A discharge chute 90 at the bottom of the refiner communicates with the annular chamber 86 for removal of the refined products from the machine.

The stock infeed to the refiner, as indicated above, is controlled by the infeed conveyors 20*a* and 20*b*. Conveyor screws are respectively mounted in the infeed conveyor housings and driven by feed motors M2 and M3 which are connected to the feed screws by variable speed drive units. The infeed stock passes from the infeed conveyors through the internal conduits 100*a* and 100*b* and exits through inclined openings 102*a* and 102*b* in the bottom thereof into the annular stock feed passages 104*a* and 104*b* coaxial with the rotor shaft. Sleeves 106*a* and 106*b* mounted on the rotor shaft abutting each side of the rotor disc and secured thereagainst by nuts 108*a* and 108*b* support ribbon type screw conveyor elements 110*a* and 110*b* within the chambers 104*a* and 104*b*, respectively. The ribbon conveyor screws 110*a* and 110*b* have opposite pitch angles selected so that rotation of the rotor will advance infeed stock from the conduits 100*a* and 100*b* toward the rotor disc and into the throat regions of the refining plates. Similarly, the infeed conveyor screws are of opposite pitch angles, the one screw being rotated counterclockwise and the other screw being rotated clockwise, as viewed in FIG. 4, so that the feed stock will be thrown by the screws toward the rotor disc through the inclined openings 102*a* and 102*b*.

The ribbon screws 110*a* and 110*b* are utilized to permit steam generated during the refining of low consistency stock to escape along the tubes 106*a* and 106*b* into the steam discharge spouts 112*a* and 112*b* at the ends of the casing sections. A suitable seal assembly, only one of which is shown at 114*a*, is provided at each end of the ribbon screw conveyors 110*a* and 110*b* to prevent steam and stock particles from passing to the bearing region of the rotor.

The mechanical operation of the refiner should to a large extent be obvious from the above discussion of the refiner structure and will be summarized prior to considering the details of the plate clash protection system of the present invention. With the rotor driven at a predetermined speed by the refiner motor M1, the stock to be refined is fed from the bin 12 by feeders 16*a* and 16*b* into infeed conveyors 20*a* and 20*b*. The feed motors M2 and M3 drive the infeed conveyors at a predetermined rate of speed. The stock passing the infeed conveyors is advanced by the ribbon conveyors 110*a* and 110*b* into the throat of the refining plates on each side of the disc and is centrifugally passed between opposed sets of refining plates 54*a* and 80*a*, and 54*b* and 80*b*. The close spacing of the plates, which may be only a few thousandths of an inch, causes a fiberization of the stock and in the process generates a considerable amount of steam which escapes axially back through the ribbon conveyor and out through the steam discharge spouts 112*a* and 112*b*. The refined stock passes from the refiner through the discharge conduit 90.

With reference, in particular, to FIGS. 1, 3 and 4, the plate clash protection system of this invention is disclosed in detail. As shown in FIG. 1, the pairs of hydraulic piston cylinder assemblies 58*a* and 58*b*, that are connected to axially movable heads 56*a* and 56*b* (FIG. 4), are hydraulically connected in parallel relation. That is to say that each piston-cylinder assembly 58 (FIG. 3) is of the double-acting type having common chambers on one side of the piston hydraulically connected together and common chambers on the other side of the piston hydraulically connected together. More specifically, each piston-cylinder assembly 58 is comprised of a cylinder 57 and a centrally located piston 55 slidably received therewithin to define with said cylinder a chamber 51 on one side of the piston 55 and a chamber 53 on the other side of the piston. For communication of hydraulic fluid with these chambers 51 and 53 there are respectively provided threaded apertures or ports 59 and 61 to receive hydraulic fittings. For the purposes of this invention, chambers 51 will be referred to as the high pressure chambers or attrition force-producing chambers and chambers 53 will be referred to as the low pressure chambers, back pressure chambers or counter-force-producing chambers.

As inferred above, the present invention involves the use of a high pressure hydraulic circuit 200 and a low pressure hydraulic circuit 300. For the sake of clarity, in FIG. 1, all hydraulic circuits are illustrated in solid lines and all electrical circuits are illustrated in dotted lines leading to an electrical control panel, indicated as such, at the lower, right of FIG. 1. Further, with reference to FIG. 1, the plate clash protection system of this invention comprises, in addition to high pressure circuit 200 and low pressure circuit 300: an electrical-signal-producing pressure transmitter PT interposed, as shown, in each of the hydraulic circuits; a solenoid actuated, 3 position, 4-way directional valve 302 interposed in the low pressure hydraulic circuit 300; and, a solenoid actuated, 2 position, 4-way directional valve 202 interposed in the high pressure hydraulic circuit 200. Moreover, as shown, there is provided a by-pass conduit or circuit 304 arranged in hydraulically parallel relation about low-pressure valve 302 and having a check valve 306 located therein to permit flow of hydraulic fluid only in a direction toward the counter-force-producing chambers 53 of piston-cylinder assemblies 58. Furthermore, for reasons to be more apparent hereinafter, there is provided a cross-over conduit or circuit 400 interconnecting the high pressure valve 202 and the low pressure valve 302. Also, a sump 204 is associated with high pressure valve 202.

In addition to the above, for the provision of high pressure hydraulic fluid there is provided a pump 206 driven by a motor EM to take hydraulic fluid from a reservoir or source 208 and deliver it at a desired high pressure to high pressure valve 202. Also included, although not essential to the practice of the invention, is a manual, high pressure relief valve interposed in the high pressure circuit between the pump 206 and the high pressure valve 202 and a suitable sump 212 associated therewith. On the other hand, for the provision of low pressure hydraulic fluid, there is provided, on the refiner side of the high pressure valve 202, a motorized pressure relief valve 308 interposed in the high pressure circuit or conduit 200 and, connected to its outlet or discharge side, as shown, a manual pressure relief valve 310 to provide by a cascading pressure relief system the desired low pressure hydraulic fluid which is then directed via low pressure conduit or circuit 300 to the low pressure valve 302. Of course, as shown, a suitable sump 312 is associated with pressure relief valve 310.

As stated above, an object of this invention is to provide an automatic control mechanism to prevent contact-clashing of refiner plates on short term losses of feed and to sense long term losses of feed so as to open the refiner plates before contact-clashing occurs. Prior to this invention, the practice employed by applicant's assignee, to produce the attrition force necessary for refining, was to employ what could basically be denominated a constant force system. In that system, as is desclosed in U.S. Pat. No. 3,847,359, hydraulic pressure acting in one direction generated the necessary force to oppose the refining force produced between the refiner plates. When the refiner force was interrupted, by loss of feed for example, the hydraulic force being constant overloaded the plates causing contact-clashing and ultimately damage to the plates. In accordance with the present invention, a back pressure or counter-force is applied, preferably to the piston-cylinder assemblies producing the attrition force, such that the counter-force acts in opposition to the attrition force and in the same direction as the force produced between the refiner plates. For example, if under the prior system a 900 PSI pressure was applied to the attrition force-producing piston-cylinder assemblies, under the present system there is applied, for example, a 1,250 PSI pressure to the side of the piston acting to produce the attrition force and a 350 PSI back pressure or counter-force producing pressure to the opposite side of the piston. Thus, in the present case a 900 PSI attrition force-producing pressure is present, as was present in the prior art system, and, accordingly, the same horsepower is applied to the plates in both systems. However, as will be clear hereinafter, with the instant system, on loss of feed, plate clashing is prevented.

With reference to FIG. 1, the high pressure hydraulic valve 202 and the low pressure hydraulic valve 302 are, respectively, a two (2) position valve and a three (3) position valve. As viewed in FIG. 1, in the positions shown, both valves are in their "close" mode. When high pressure valve 202 is shifted to the left, as viewed, it is placed in its second position which is its "open" mode. Low pressure valve 302, on the other hand, when shifted to the left, as viewed, has a second or intermediate position where hydraulic flow is blocked and is thus denominated its "lock" mode. The third position of this valve when further shifted to the left, as viewed, is its "open" mode.

Typically, the operation of the refiner of this invention might proceed in the following manner. With the refiner plates open, stock in the refiner and all drive motors operating, the high pressure and low pressure valves, 202 and 302, respectively, are placed in their "close" mode or the position shown in FIG. 1. This will pressurize the hydraulic piston-cylinder assemblies 58*a* and 58*b* such that a higher pressure is in chamber 51 than in chamber 53 and, accordingly, in a brief time the refiner plates will assume their desired close spacing for continuous refining. As soon as the refining operation has stabilized, the low pressure valve 302 is shifted to its "lock" mode. With the low pressure valve 302 in its "lock" mode, the check valve 306 will assure that the back pressure or counter-force-producing pressure in chambers 53 remains constant in the event of a loss of hydraulic fluid from the low pressure side of the system as, for example, by leakage of hydraulic fluid. At this point in the refiner operation the attrition force produced in chambers 51 is balanced by the back pressure or counter-force-producing pressure in chambers 53 plus the refining force or the force produced between the refining plates.

Assuming that at some point during operation of the refiner the load drops, as by loss of feed, for example, the attrition force is no longer balanced by the counter-force and the refining reaction force. Accordingly, the back pressure in chamber 53 increases and this increase in pressure is sensed by the low pressure PT monitor which, in a known manner, indicates this increase in pressure by transmitting an appropriate electrical signal to the electrical control panel 500. In a specific method of operation of the invention, although other parameters could be chosen, when the back pressure increases to 25 PSI, a timer starts. If the back pressure doesn't reach 100 PSI in five seconds, the low pressure valve will automatically cycle "lock-close-lock", the loss of feed was not significant, therefore, the system is reset. The reason for cycling the low pressure valve from its "lock" mode to its "close" mode and back to its "lock" mode is that, in actual operation, there is an indication of excessive oil in the back pressure chambers 53 after a drop of load. While this condition is not fully understood, it is surmised that hydraulic fluid may aspirate through the check valve 306 as machine stretch and compressions are relieved upon the dropping of the load. In any event, it is known that the "lock-close-lock" cycle will reestablish equilibrium and the system is reset.

However, should, for example, the back pressure reach or exceed the 100 PSI trip or set point in less than five seconds, using a present choice of parameters, a second timer starts. If, under the chosen conditions, the back pressure decreases to 100 PSI in less than twelve seconds, it indicates that the feed has been reestablished and, accordingly, the low pressure valve is automatically cycled "lock-close-lock" to reset the system. If, on the other hand, the back pressure exceeds 100 PSI without decreasing again to 100 PSI in less than twelve seconds, the plates are automatically opened. This is accomplished by the two (2) and three (3) position valves being automatically shifted to their "open" mode such that high pressure hydraulic fluid is directed or transmitted to the back pressure chambers 53 and the hydraulic fluid from the attrition chambers 51 is allowed to flow into the sump 204. When this occurs, corrective action is then taken and the operation is restarted.

It will be apparent to those skilled in the art that, while the present invention has been shown and described in connection with a twin refiner, it will work equally as well on a single disc refiner, such as the one described in U.S. Pat. No. 3,885,665, assigned to the assignee of the present invention and incorporated herein by reference. The only difference between its use with a single disc refiner and a twin disc refiner is the number of piston-cylinder assemblies operatively connected to the refiner head or heads. Moreover, the invention could be adapted to a refiner construction such as disclosed in U.S. Pat. No. 3,893,631, also assigned to the assignee of this invention and incorporated herein by reference. In fact, the principles of this invention are believed to have unlimited application to refiners, although, in certain instances, some modification of the machine design may be necessitated. Accordingly, it should be understood that, within the scope of the appended claims, the invention may be practiced otherwise than as illustrated and described.

What is claimed is:

1. A disc type refiner comprising:

(a) a pair of refining plate assemblies constructed and arranged to be adjustably spaced relative to each other;

(b) an attrition force-producing means and a counter-force-producing means operatively connected to at least one of said refining plate assemblies, said attrition force-producing means being constructed and arranged to provide substantially all of the attrition force required for refining and said counter-force-producing means being constructed and arranged to continuously coact at a substantially constant predetermined value with the attrition reaction-force, produced during refining, in a direction opposite that produced by said attrition force-producing means, and said attrition force-producing means and said counter-force-producing means comprising a hydraulic piston-cylinder assembly provided with means to stimultaneously introduce pressurized hydraulic fluid to both sides of said piston, the cylinder chamber adjacent one side of said piston being the attrition force-producing chamber and the cylinder chamber adjacent to the other said of said piston being the counter-force-producing chamber; and (c) means to continuously monitor the counter-force, produced by said counter-force-producing means during refining, so as to maintain said counter-force at said substantially constant predetermined value, said means to monitor including means to sense the counter-force-producing pressure in said counter-force-producing chamber and means responsive to a predetermined increase in said counter-force-producing pressure over a predetermined period of time to adjust said counter-force-producing pressure to said substantially constant predetermined value.

2. A disc type refiner as in claim 1 which further includes means to sense the counter-force-producing pressure in said counter-force-producing chamber and means responsive to a predetermined increase without a predetermined decrease in said counter-force-producing pressure, over a predetermined period of time, to simultaneously reduce the attrition force-producing pressure in said attrition force-producing chamber and increase the counter-force-producing pressure in said counter-force-producing chamber.

3. A disc type refiner as in claim 2 wherein said means to monitor includes means responsive to a predetermined increase in said counter-force-producing pressure over a predetermined period of time to adjust said counter-force-producing pressure to said substantially constant predetermined value.

4. A disc type refiner as in claim 3 wherein said means to simultaneously introduce pressurized hydraulic fluid to both sides of said piston includes high-pressure conduit means to provide high pressure hydraulic fluid from a source to said attrition force-producing chamber, pressure relief means interposed in said high-pressure conduit means to provide low pressure hydraulic fluid for said counter-force-producing chamber, low pressure conduit means interconnecting said pressure relief means and said counter-force-producing chamber, a two position, high-pressure valve means interposed in said high-pressure conduit means, and a three position, low-pressure valve means interposed in said low-pressure conduit means such that, in a first position of said high-pressure valve means and in a first position of said low-pressure valve means, high pressure hydraulic fluid is permitted to flow to said attrition force-producing chamber and low pressure hydraulic fluid is permitted to flow to said counter-force-producing chamber.

5. A disc type refiner as in claim 4 wherein said low-pressure conduit means further includes by-pass conduit means about said low-pressure valve means and a check valve in said by-pass conduit means to permit flow of hydraulic fluid only in a direction toward said counter-force-producing chamber.

6. A disc type refiner as in claim 5 wherein said three position, low-pressure valve means is constructed and arranged to have a second position wherein hydraulic fluid flow is prevented either to or from said counter-force-producing chamber through said low pressure valve.

7. A disc type refiner as in claim 6 which further includes cross-over conduit means interconnecting said high-pressure valve means and said low-pressure valve means, said high pressure valve means and said low-pressure valve means being constructed and arranged such that, in a second position of said high-pressure valve means, hydraulic fluid flows from said high pressure source to said cross-over conduit means, through said low-pressure valve means, to said counter-force-producing chamber and, simultaneously, hydraulic fluid flows from said attrition force-producing chamber, through said high-pressure valve means, to a sump.

8. A disc type refiner as in claim 7 which comprises two pairs of refiner plate assemblies arranged in tandem and four hydraulic piston cylinder assemblies arranged hydraulically in parallel relation, with two of said hydraulic piston cylinder assemblies being operatively connected to each of said pairs of refiner plate assemblies.

9. A disc type refiner comprising:

(a) a base;

(b) a rotor mounted for rotation on said base;

(c) a motor for driving said rotor in rotation;

(d) a refining surface on said rotor;

(e) a non-rotating head on said base;

(f) a refining surface on said non-rotating head in juxtaposed relation to said rotor refining surface;

(g) feed means for introducing materials to be refined between said refining surfaces;

(h) means for axially adjusting the position of said non-rotating head to control the spacing of said juxtaposed refining surfaces, said position adjusting means including attrition force-producing means and counter-force-producing means operatively connected to said non-rotating head, said attrition force-producing means being constructed and arranged to provide substantially all of the attrition force required for refining and said counter-force-producing means being constructed and arranged to continuously coact at a substantially constant predetermined value with the attrition reaction-force produced druing refining, in a direction opposite that produced by said attrition force-producing means and said attrition force-producing means and said counter-force-producing means comprising a hydraulic piston-cylinder assembly provided with means to simultaneously introduce pressurized hydraulic fluid to both sides of said piston, the cylinder chamber adjacent one side of said piston being the attrition force-producing chamber and the cylinder chamber adjacent the other side of said piston being the counter-force producing chamber; and (i) means to continuously monitor the counter-force, produced by said counter-force-producing means during refining, so as to maintain said counter-force at said substantially constant predetermined value, said means to monitor including means to sense the counter-force-producing pressure in said counter-force-producing chambers and means responsive to a predetermined increase in said counter-force-producing pressure over a predetermined period of time to adjust said counter-force-producing pressure to said substantially constant predetermined value.

10. A disc type refiner comprising:

(a) a base;

(b) a casing on said base;

(c) a rotor passing through said casing and mounted for rotation therewithin, said rotor being axially fixed with respect to said casing and comprising a rotor disc extending radially therefrom and having refining plates mounted on each axial face thereof;

(d) a motor operatively connected to said rotor for driving said rotor in rotation;

(e) a non-rotating head mounted within said casing adjacent each axial face of said rotor disc;

(f) refining plates on each of said non-rotating heads juxtaposed said rotor refining plates;

(g) feed means for introducing materials to be refined between said refining surfaces;

(h) means for axially adjusting the position of said non-rotating head to control the spacing of said juxtaposed refining surfaces, said position adjusting means including attrition force-producing means and counter-force-producing means operatively connected to said non-rotating heads, said attrition force-producing means being constructed and arranged to provide substantially all of the attrition force required for refining and said counter-force-producing means being constructed and arranged to continuously coat at a substantially constant predetermined value with the attrition reaction-force, produced during refining, in a direction opposite that produced by said attrition force-producing means and said attrition force-producing means and said counter-force-producing means comprising a hydraulic piston-cylinder assembly provided with means to simultaneously introduce pressurized hydraulic fluid to both sides of said piston, the cylinder chamber adjacent one side of said piston being the attrition force-producing chamber and the cylinder chamber adjacent the other side of said piston being the counter-force producing chamber; and (i) means to continuously monitor the counter-force, produced by said counter-force-producing means during refining, so as to maintain said counter-force at said substantially constant predetermined value, said means to monitor including means to sense the counter-force-producing pressure in said counter-force-producing chambers and means responsive to a predetermined increase in said counter-force-producing pressure over a predetermined period of time to adjust said counter-force-producing pressure to said substantially constant predetermined value.

11. A disc type refiner comprising:

(a) a base;

(b) a casing supported by said base;

(c) a drive shaft extending through said casing;

(d) means on said casing for rotably supporting said drive shaft;

(e) a pair of stationary heads mounted within said casing in spaced opposed relation;

(f) a refining plate assembly radially disposed on each said stationary head;

(g) a pair of rotating heads mounted on said drive shaft;

(h) a refining plate assembly on each said rotating head in parallel juxtaposed relation to the refining plate assembly of the adjacent stationary head;

(i) means connecting said drive shaft and said rotating heads to provide rotation of said head with said shaft while permitting axial movement thereof along said shaft;

(j) conveying means for directing stock to be refined into said casing between said juxtaposed refining plate assemblies;

(k) means for adjusting the axial position of said rotating heads on said drive shaft, said position adjusting means including attrition force-producing means and counter-force-producing means operatively connected to said rotating heads, said attrition force-producing means being constructed and arranged to provide substantially all of the attrition force required for refining and said counter-force-producing means being constructed and arranged to continuously coact at a substantially constant predetermined value with the attrition reaction-force, produced during refining, in direction opposite that produced by said attrition force-producing means and said attrition force-producing means and said counter-force-producing means comprising a hydraulic piston-cylinder assembly provided with means to simultaneously introduce pressurized hydraulic fluid to both sides of said piston, the cylinder chamber adjacent one side of said piston being the attrition force-producing chamber and the cylinder chamber adjacent the other side of said piston being the counter-force-producing chamber; and (l) means to continuously monitor the counter-force produced by said counter-force-producing means during refining, so as to maintain said counter force at said substantially constant predetermined value, said means to monitor including means to sense the counter-force-producing pressure in said counter-force-producing chambers and means responsive to a predetermined increase in said counter-force-producing pressure over a predetermined period of time to adjust said counter-force-producing pressure to said substantially constant predetermined value.

12. A disc type refiner comprising:

(a) two pairs of refining plate assemblies arranged in tandem, with each pair of refining plate assemblies being constructed and arranged to be adjustably spaced relative to each other;

(b) attrition force-producing means and counter-force-producing means operatively connected to at least one of said refining plate assemblies of each of said pairs of refining plate assemblies, said attrition force-producing means being constructed and arranged to provide substantially all of the attrition force required for refining and said counter-force-producing means being constructed and arranged to continuously coact at a substantially constant predetermined value with the attrition reaction-force, produced during refining, in direction opposite that produced by said attrition force-producing means;

(c) each said attrition force-producing means and said counter-force-producing means comprising a pair of hydraulic piston cylinder assemblies arranged hydraulically in parallel relation with each other and with the other said pair of hydraulic piston cylinder assemblies, each piston cylinder assembly being provided with means to simultaneously introduce pressurized hydraulic fluid to both sides of its piston, the cylinder chamber adjacent one side of each said piston being the attrition force-producing chamber and the cylinder chamber adjacent the other side of each said piston being the counter-force-producing chamber; and (d) means to continuously monitor the counter-force, produced by said counter-force-producing means during refining, so as to maintain said counter force at said substantially constant predetermined value, said means to monitor including means to sense the counter-force-producing pressure in said counter-force-producing chambers and means responsive to a predetermined increase in said counter-force-producing pressure over a predetermined period of time to adjust said counter-force-producing pressure to said substantially constant predetermined value.

* * * * *